US010132467B2

(12) United States Patent
Poppenheimer et al.

(10) Patent No.: US 10,132,467 B2
(45) Date of Patent: Nov. 20, 2018

(54) LED LUMINAIRE

(71) Applicant: AMERLUX LLC, Oakland, NY (US)

(72) Inventors: Tori Poppenheimer, Cambria (CA); P. David Ziolkowski, Richmond Heights, MO (US)

(73) Assignee: AMERLUX LLC, Oakland, NJ (US)

( * ) Notice: Subject to any disclaimer, the term of this patent is extended or adjusted under 35 U.S.C. 154(b) by 0 days.

(21) Appl. No.: 15/712,492

(22) Filed: Sep. 22, 2017

(65) Prior Publication Data

US 2018/0080622 A1 Mar. 22, 2018

Related U.S. Application Data

(60) Provisional application No. 62/398,369, filed on Sep. 22, 2016.

(51) Int. Cl.

| | |
|---|---|
| ***F21V 7/00*** | (2006.01) |
| ***F21V 21/02*** | (2006.01) |
| ***F21V 21/34*** | (2006.01) |
| ***F21V 15/01*** | (2006.01) |
| ***F21V 21/10*** | (2006.01) |
| *F21W 131/10* | (2006.01) |
| *F21W 131/103* | (2006.01) |
| *F21Y 115/10* | (2016.01) |
| *F21Y 113/13* | (2016.01) |
| *F21Y 113/17* | (2016.01) |

(52) U.S. Cl.

CPC ..... *F21V 7/005* (2013.01); *F21V 15/01* (2013.01); *F21V 21/02* (2013.01); *F21V 21/10* (2013.01); *F21V 21/34* (2013.01); *F21V 7/0016* (2013.01); *F21W 2131/10* (2013.01); *F21W 2131/103* (2013.01); *F21Y 2113/13* (2016.08); *F21Y 2113/17* (2016.08); *F21Y 2115/10* (2016.08)

(58) Field of Classification Search

CPC ..... F21V 7/005; F21V 15/01; F21V 21/02; F21V 21/10; F21V 21/34; F21V 7/0016; F21Y 2113/13; F21Y 2113/17

USPC ..... 362/217.14, 248, 410, 413

See application file for complete search history.

(56) References Cited

U.S. PATENT DOCUMENTS

| | | | | |
|---|---|---|---|---|
| 6,060,658 | A * | 5/2000 | Yoshida | F21S 8/086 136/243 |
| 8,382,347 | B2 * | 2/2013 | McCanless | F21S 8/088 362/249.02 |
| 9,420,661 | B2 * | 8/2016 | Martzall | F21V 23/04 |
| 2009/0296392 | A1 * | 12/2009 | Wilcox | F21S 8/081 362/249.02 |
| 2012/0140495 | A1 * | 6/2012 | Zhang | F21S 6/002 362/431 |

(Continued)

FOREIGN PATENT DOCUMENTS

| | | |
|---|---|---|
| EP | 3075368 | * 10/2016 |

*Primary Examiner* — Laura Tso

(74) *Attorney, Agent, or Firm* — Day Pitney LLP

(57) ABSTRACT

A luminaire includes an elongate supporting post including an upper head section that flares outwardly, and a cap positioned on top of the head of the supporting post, the cap including a plurality of LED lighting units arranged circumferentially, and a shield adapted to block a substantial amount of outwardly directed light emitted from the plurality of LED lighting units, such that the light emitted from the LED lighting units is directed substantially onto the supporting post. A method of fabrication is provided.

10 Claims, 6 Drawing Sheets

(56) References Cited

U.S. PATENT DOCUMENTS

| | | | | |
|---|---|---|---|---|
| 2013/0049609 | A1* | 2/2013 | Browder | G09F 27/007 315/159 |
| 2016/0025286 | A1* | 1/2016 | Wang | F21V 29/83 362/225 |

* cited by examiner

LED LUMINAIRE

CROSS REFERENCE TO RELATED APPLICATION

This application is filed under 35 U.S.C. § 111(a) and claims priority under 35 U.S.C. § 119(e) to U.S. Provisional Patent Application 62/398,369, entitled "LED Luminaire," filed on Sep. 22, 2016; the entire disclosure of which is incorporated herein in its entirety.

BACKGROUND OF THE INVENTION

1. Field of the Invention

The subject matter disclosed herein relates generally to lighting devices and more particularly to a luminaire device that employs light emitting diodes (LEDs) as a light source.

2. Description of the Related Art

LEDs are being employed to an ever greater extent for external lighting applications due to their power efficiency and flexibility. LEDs are employed, for example, in luminaires, which are stand-alone lighting units which may include one or more LED lamps or lanterns. Luminaires have been employed in traffic lighting, pathway lighting, and parking lot lighting, among other public uses. The luminaire structures currently marketed and in use typically employ a bright luminaire head mounted on a dark pole. For the viewer, the resulting strong contrast between the bright luminaire head and darker pole creates a glaring two-piece (bright vs. dark) solution that is not an optimal for many lighting applications.

What are needed are LED luminaire solutions that provide a more unified, aesthetic design that avoids glare.

SUMMARY OF THE INVENTION

In one embodiment, a luminaire is provided which includes an elongate supporting post including an upper head section that flares outwardly, and a cap positioned on top of the head of the supporting post, the cap including a plurality of LED lighting units arranged circumferentially, and a shield adapted to block a substantial amount of outwardly directed light emitted from the plurality of LED lighting units, such that the light emitted from the LED lighting units is directed substantially onto the supporting post.

The luminaire may include at least one optical element positioned so as to reflect light emitted from the plurality of LED lighting units toward the support post; one or more of the plurality of LED lighting units may include multicolored LEDs; the luminaire may also include a controller for adjusting the color emitted by the multicolored LED lighting units; the supporting post may be composed of aluminum; the aluminum of the support post may include a light-colored, such as matte or glossy white, or a darker-colored finish.

BRIEF DESCRIPTION OF THE DRAWINGS

The features and advantages of the invention are apparent from the following description taken in conjunction with the accompanying drawings in which.

DETAILED DESCRIPTION OF THE INVENTION

Disclosed herein are LED luminaire apparatus and methods that provide a unique illumination in which an upper head portion and a lower post portion of a luminaire are illuminated seamlessly together. In an exemplary embodiment, the luminaire includes a generally tubular or cylindrical support post which flares outwardly at an upper portion referred to as the "head" of the luminaire. A cap element is positioned at the top of the head, the cap element including a rim at its edge in which plurality of LED light sources are positioned. The LED light sources are configured to direct illumination inwardly towards the head and support post of the luminaire, which both creates an aesthetic, glowing effect on the support post and avoids casting light directly outwardly towards viewers.

Figure 1:
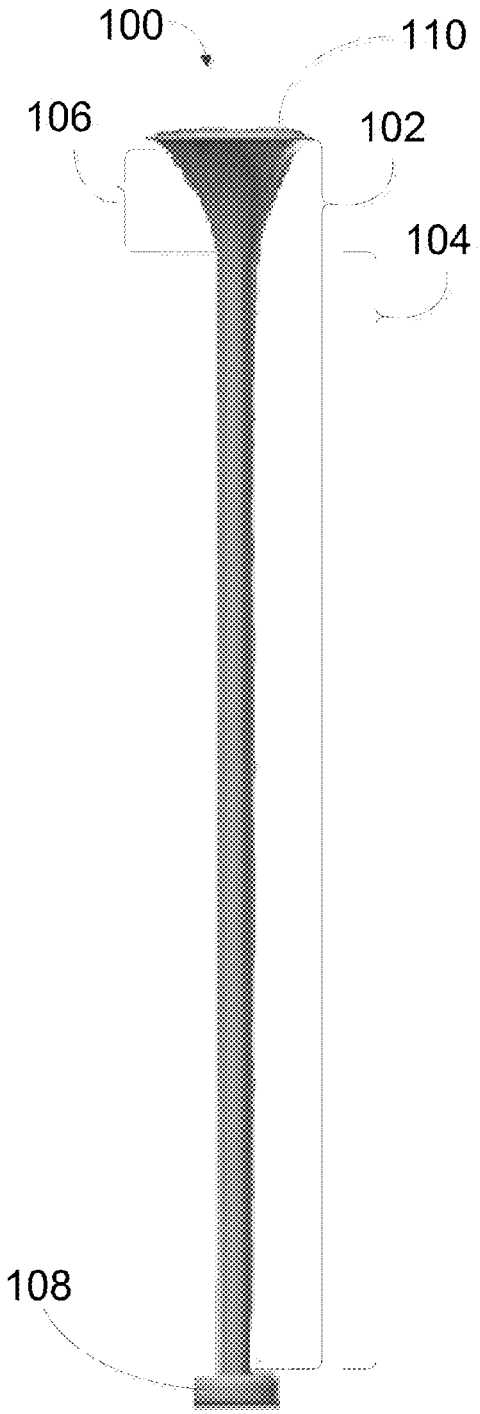
FIG. 1 is a front plan view of a luminaire according to the teachings herein.
Figure 2:
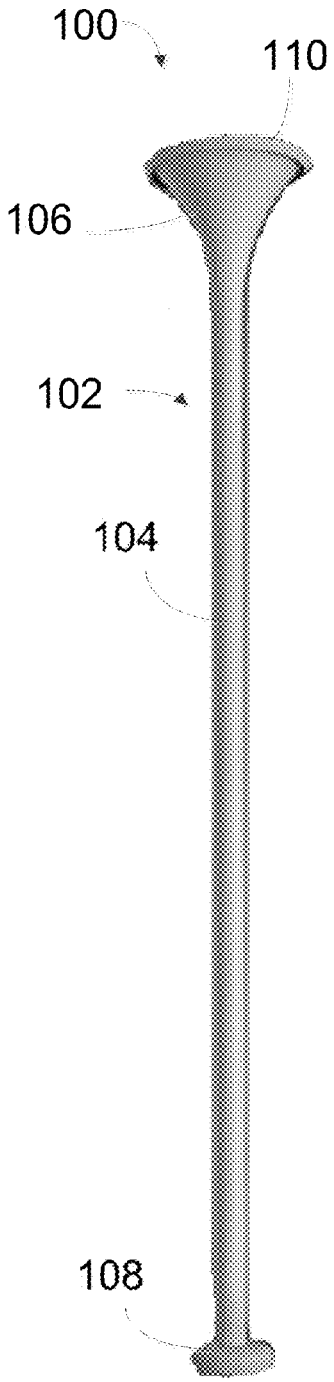
FIG. 2 is a front perspective view of the luminaire of FIG. 1.

Turning to FIG. 1, a front view of an exemplary embodiment of the luminaire 100 is shown. FIG. 2 shows a perspective view of the luminaire shown in FIG. 1. The luminaire includes a support post 102, which includes a lower section 104 which is formed as an elongated cylindrical tube or pole, and an upper section 106 which flares outwardly from the lower section 104, referred to herein as the "head" of the luminaire. The support post rests on a pedestal 108. In some embodiments, the entire support post 102 including both lower and upper sections 104, 106 may be composed of aluminum (solid or hollow). The aluminum material may be polished, given a light-colored finish, such as matte or glossy white, or in some embodiments, may be given a colored finish. The different finishes may complement use of white or color-emitting LEDs to maximize self-illumination. A generally disc-shaped removable cap 110 is coupled to the top of the upper section 106 of support post 102. The cap 110 includes a circumferential rim in which a plurality of LED lighting units are placed (not shown in FIGS. 1 and 2).

Figure 3:
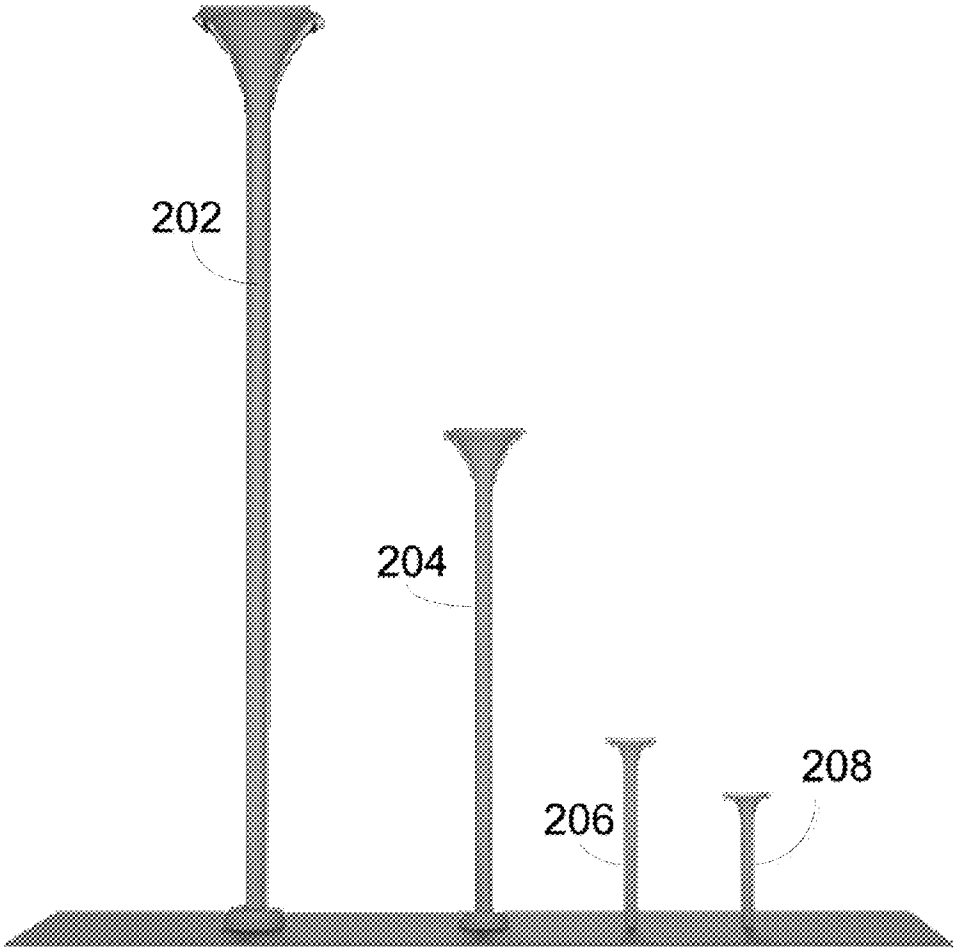
FIG. 3 is a front plan view showing various embodiments of different sizes of the luminaire according to the teachings herein.

The luminaire may be produced in a number of sizes to best match a variety of lighting applications. FIG. 3 shows four exemplary luminaires 202, 204, 206, 208 of different heights. Luminaire 202 may have a height of approximately 16 feet (16'), a support post diameter of approximately 6 inches (6"), and a cap diameter in a range of 27 inches (27") to 33 inches (33"); luminaire 204 may have a height of approximately 10 feet (10'), a support post diameter of approximately 6 inches (6"), and a cap diameter in a range of 27 inches (27") to 32 inches (32"); luminaire 206 may have a height of approximately 42 inches (42"), a support post diameter of approximate 3 inches (3"), and a cap diameter in a range of 17 inches (17") to 20 inches (20"); and luminaire 208 may have a height of approximately 18 inches (18"), a support post diameter of approximately 3 inches (3"), and a cap diameter in a range of 8 inches (8") to 10 inches (10"). The exemplary dimensions above indicate that the proportions of height to width of the luminaires may be varied. For example, diameter of the cap for each of luminaires 202 and 204 is the same, while the height of each of luminaires 202 and 204 is different, resulting in different height-to-width ratios.

Figure 4:
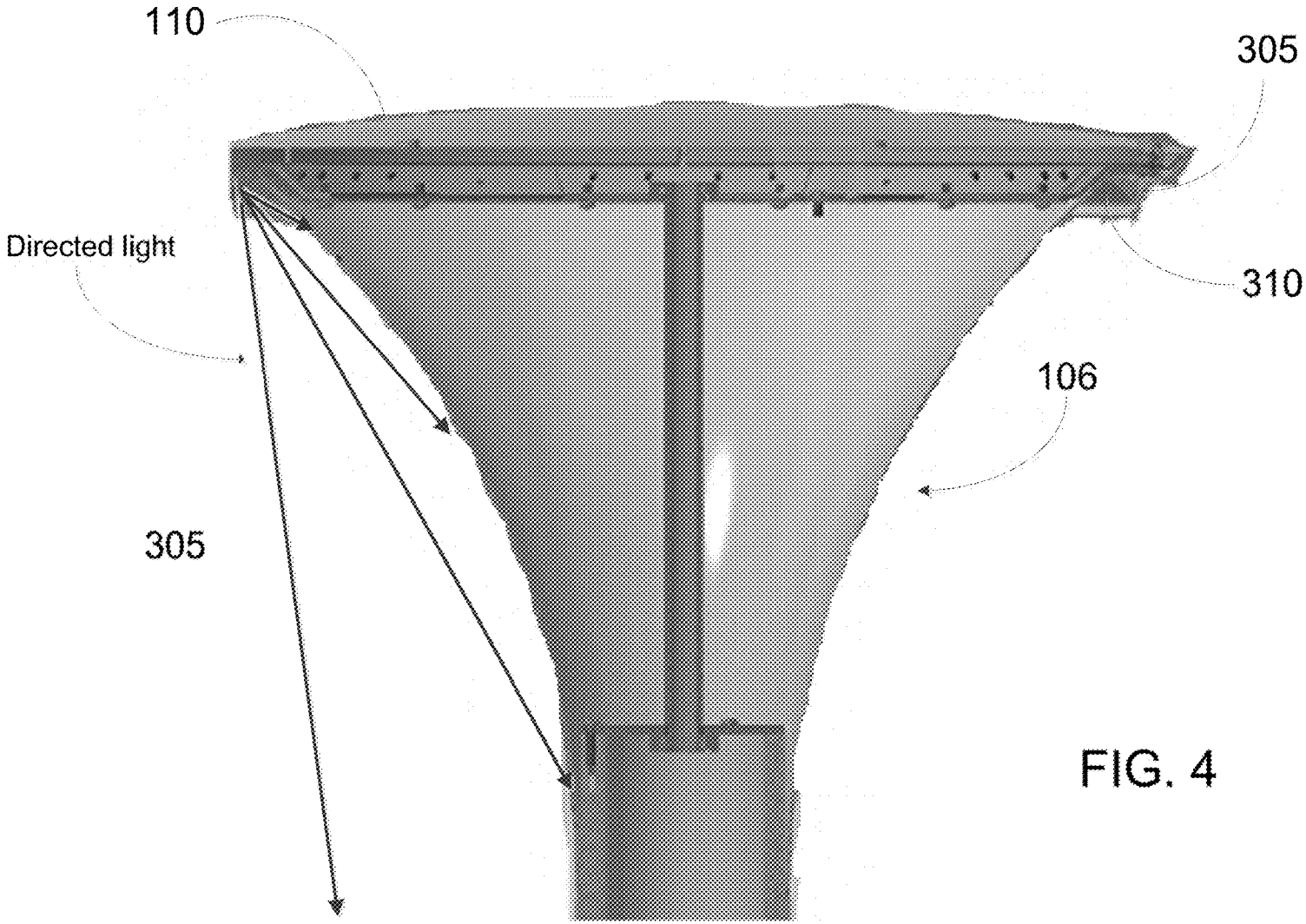
FIG. 4 is a front plan view of the upper section (head) of the luminaire according to the teachings herein.

Turning to FIG. 4, aspects of an exemplary head 106 and cap 110 of the luminaire 100 are shown. The cap 110 may be affixed to the head 106 by threaded couplings such as screws or bolts to allow removability of the cap from the luminaire and thus repair and replacement of LED lighting units. The cap 110 includes a shield 305 along a circumferential rim which is angled downwardly and inwardly over the edge of the head 106 of the luminaire. The space between the shield 305 and head 106 and defines a concealed recess 310 along the rim in which LED lighting units may be placed. By a combination of optics (which may include lenses, reflectors, collimators and other components known in the art), radiation emitted from the LEDs is directed downwardly and largely inwardly so as to graze the surface of the head 106 and lower section 104 of the support post 102. For light that passes the support post 102 or is reflected towards ground level, the resulting light distribution at ground level is "Lambertian." A Lambertian distribution is one in which the light intensity distribution is diffuse and the apparent brightness is approximately the same regardless of the observer's angle of view. Importantly, by directing a substantial majority of the intensity of light toward the support port 102, only a small portion of the intensity is directed directly at a viewer positioned in the vicinity of the luminaire, which reduces overall glare.

Figure 5:
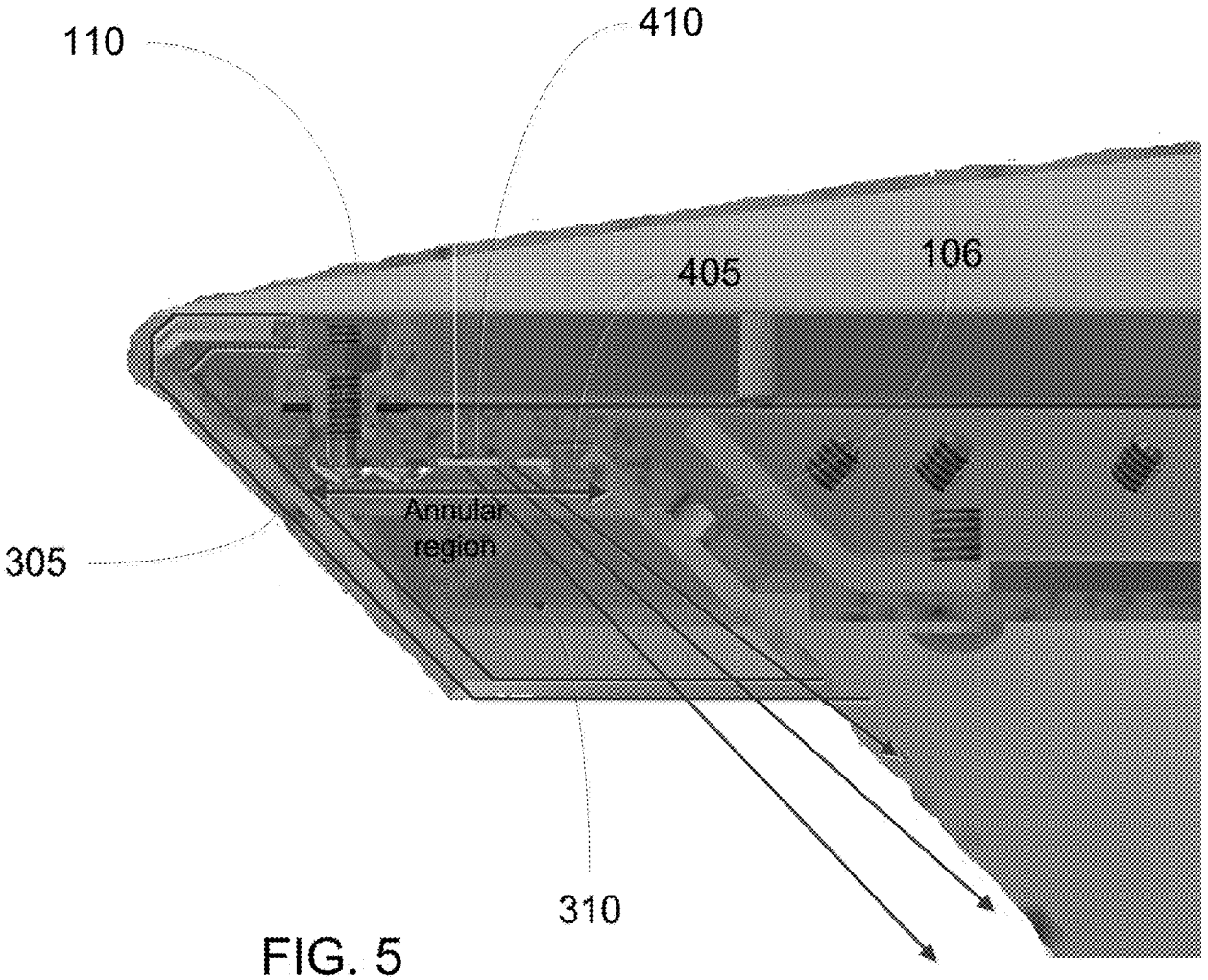
FIG. 5 is a cross-sectional view of the cap portion of the luminaire according of the teachings herein taken from the center to the circumference.

FIG. 5 is a radial cross-sectional view of an exemplary cap 110, which illustrates the concealed recess 310 between the shield 310 and head 106 of the luminaire as well as the position of LED lighting units. As shown, at the bottom of cap 110 an annular region 405 is defined between the shield 305 and the edge of the head 106. A plurality of LED lighting units, e.g., 410 are affixed to the bottom of the annular region 405. The LED lighting units 410 may include white LEDs or tri-colored (e.g., red-green-blue) LEDs either alone or in combination. Tri-colored LEDs have the advantage that millions of color combinations can be achieved through color-changing dimming and/or DMX (Digital Multiplex) controls. A number of LED lighting units 410 may be placed on the annular region 405 in a circumferential arrangement. In some embodiments, the LED lighting units 410 may be spaced about one inch apart (center-to-center) or less to ensure that pixilation or illumination hotspots do not occur. In some embodiments, particularly for the larger luminaire models, 0.5 Watt LED units may be utilized. For larger caps 110, which may have circumferences on the order of 100 inches (100"), approximately 100 lighting units may be deployed, and the total wattage out may be approximately 50 Watts.

Figure 6:
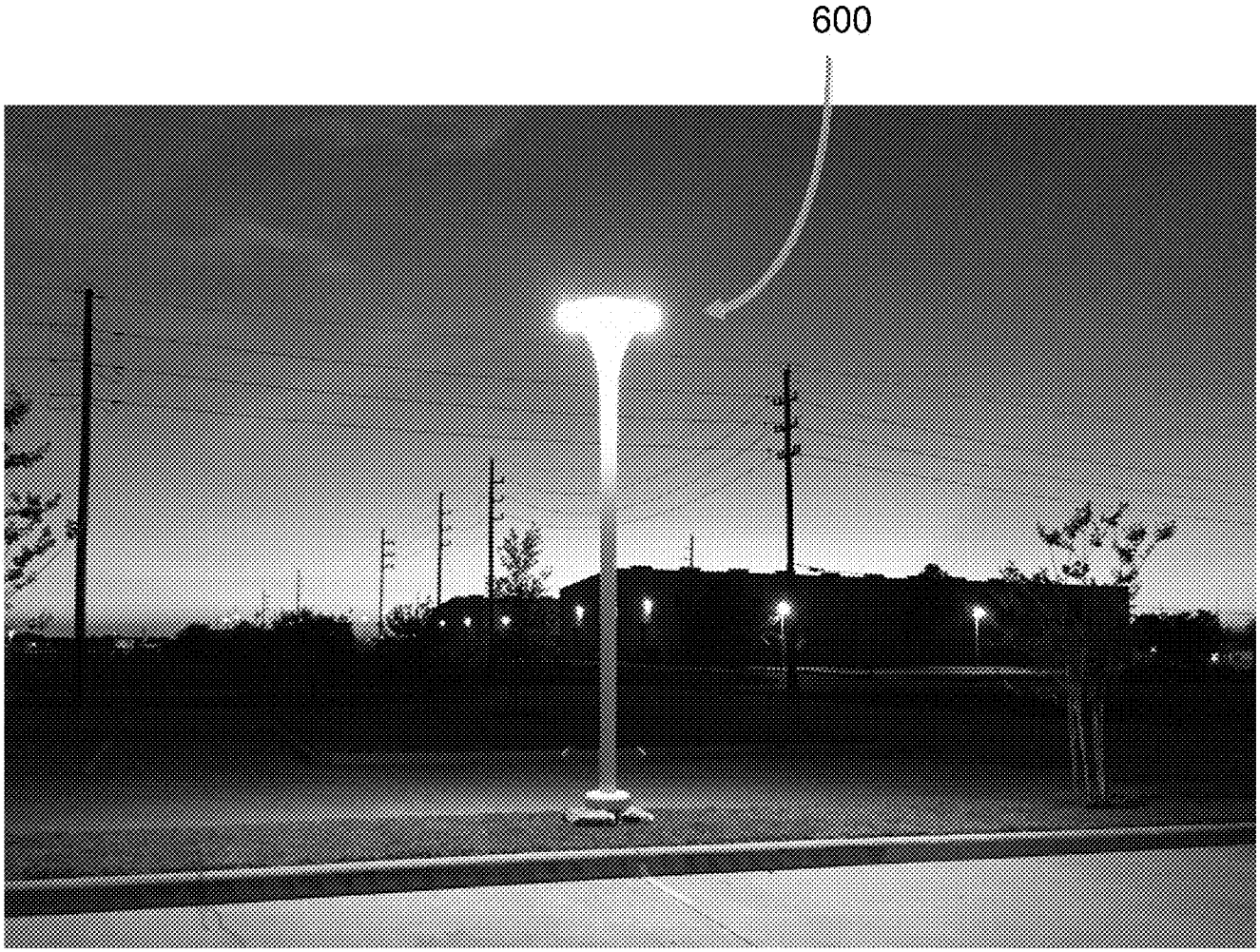
FIG. 6 is a photograph showing lighting characteristics of the luminaire according to the teachings herein.
Figure 7:
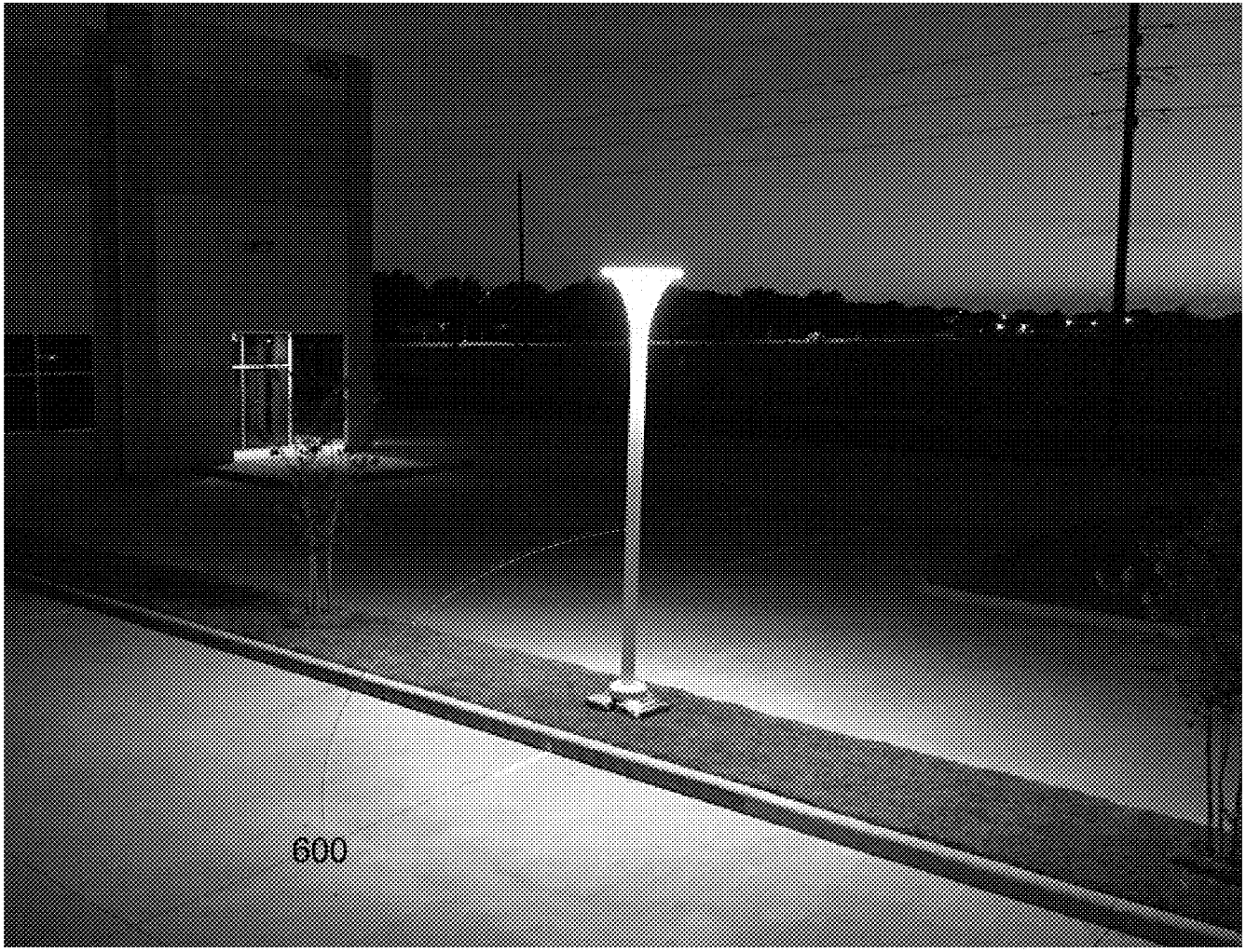
FIG. 7 is another photograph showing lighting characteristics of the luminaire according to the teachings herein.

As noted above, a large majority, which may be about 70 percent of the total light intensity produced by the LEDs, is directed onto the support post in most luminaire models. For smaller luminaire models (such as 10 inch (10") bollard models), which are designed to be mounted below viewer eye level, the optics are designed so that considerably more (e.g., more than 50 percent) of light intensity comes out of the optics directly. However even for the smaller models, a large amount of light is directed toward the support post of the luminaire. The resulting illumination, which is enhanced by the material and surface finish of the support post, is quite dramatic. FIGS. 6 and 7 show photographs taken of illuminated luminaires according to the teachings herein. FIG. 6 shows a photograph of a luminaire 600 situated along a paved area taken around sunrise or sunset. The photograph clearly shows the majority of light intensity concentrated on the upper part of the support post, which appears to glow, with less-intense, diffuse (Lambertian) surrounding ground illumination. Similarly, FIG. 7 shows a photograph of the same luminaire 600 in the same location taken at a time (or with a view) in which there is less ambient light, and the illumination cast by the luminaire appears more starkly. In this photograph as well, the diffuse, Lambertian distribution on the ground is clear, and contrasts strongly with the glowing support post. The glowing post is aesthetically interesting and pleasing, and yet does not negatively affect the viewer by glare.

The Luminaires disclosed herein are particularly useful for medium-to-high volume exterior lighting in corporate, aviation, institutional, healthcare, hospitality and college/university settings. However, with suitable modifications in terms of size, intensity, and color, the luminaires may also be used in a variety of low-volume applications.

Having thus introduced aspects of the invention, some additional features, embodiments and considerations are now set forth.

In any given lighting application, it is intended that photometrics and optical performance testing may be used to determine optimal LED wattage and spacing. It is recognized that installations at various locations will experience different conditions including shadows from nearby structures, lack or abundance of other lighting, and different intended uses. Accordingly, the use of any specific wattages or spacings in the disclosure are to be taken as exemplary and not limiting in any way.

A variety of different LED light unit systems, chips, controllers and optics may be used as deemed appropriate. For example, the lighting units may include LED bulbs, arrays, strips, puck lights, and/or custom LED products. LED chips and controllers may be selected for an appropriate output wattage, illumination intensity, and color variation capability. The optics may include convex and/or concave lenses, reflectors and collimators, among other components.

Although the luminaires have been depicted as including pedestals and freestanding, the luminaires may be designed for mounting on walls or other surfaces. For example, a luminaire according to the teachings herein may be used as a sconce lighting unit.

One skilled in the art will recognize the various uses of terms used herein and be able to make distinctions. However, if a conflict should exist, terminology as set forth in this disclosure shall prevail. It should be recognized that some adjustment and terminology has been provided to simplify explanation. No conflicts in terminology should be construed or inferred.

Terms of orientation are used herein merely for purposes of convention and referencing, and are not to be construed as limiting. For example, the terms "outward" and "downward" are used in relation to the luminaire. However, it is recognized these terms could be used with reference to a viewer. Accordingly, no limitations are implied or to be inferred.

Standards for performance, materials, assembly or other such parameters are to be judged by a designer, manufacturer, user, owner, operator or other similarly interested party. No particular requirements for any standards are implied or to be inferred by the disclosure here.

All statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Various other components may be included and called upon for providing for aspects of the teachings herein. For example, additional materials, combinations of materials and/or omission of materials may be used to provide for added embodiments that are within the scope of the teachings herein.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements. The usage of the term "exemplary" is to be construed as meaning one of many possible embodiments. The term "exemplary" is not to be construed as being necessarily indicative of a superior or superlative embodiment, although, in some instances this may be the case.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A luminaire comprising:

an elongate support post including an upper head section with a head that flares outwardly; and a cap positioned on top of the head of the support post, the cap including a plurality of LED lighting units arranged circumferentially, and optics adapted to redirect a substantial amount of light emitted from the plurality of LED lighting units onto the supporting post.

2. The luminaire of claim 1, wherein the cap includes a shield adapted to reduce glare by blocking a line of sight toward the LED lighting units.

3. The luminaire of claim 1, wherein one or more of the plurality of LED lighting units includes multicolored LEDs.

4. The luminaire of claim 3, further comprising:

a controller for adjusting the color emitted by the LED lighting units including multicolored LEDs.

5. The luminaire of claim 1, wherein the support post is composed of aluminum.

6. The luminaire of claim 5, wherein the aluminum of the support post includes one of a matte and glossy white finish.

7. The luminaire of claim 5, wherein the aluminum of the support post includes a colored finish.

8. The luminaire of claim 1, wherein ground level distribution of the light emitted is Lambertian.

9. A method for fabricating a luminaire, the method comprising:

selecting an elongate support post including an upper head section with a head that flares outwardly; and positioning a cap on top of the head of the support post, the cap including a plurality of LED lighting units arranged circumferentially, and optics adapted to redirect a substantial amount of light emitted from the plurality of LED lighting units onto the supporting post.

10. A method for providing illumination, the method comprising:

selecting a luminaire comprising: an elongate support post including an upper head section with a head that flares outwardly; and a cap positioned on top of the head of the support post, the cap including a plurality of LED lighting units arranged circumferentially, and optics adapted to redirect a substantial amount of light emitted from the plurality of LED lighting units onto the supporting post; and energizing the luminaire.

* * * * *